US009607601B2

(12) United States Patent
Wilson et al.

(10) Patent No.: US 9,607,601 B2
(45) Date of Patent: Mar. 28, 2017

(54) UNDERWATER NOISE ABATEMENT PANEL AND RESONATOR STRUCTURE

(71) Applicants: Preston Wilson, Austin, TX (US); Kevin M. Lee, Austin, TX (US); Mark S. Wochner, Austin, TX (US); Hector L. Mendez Martinez, Houston, TX (US)

(72) Inventors: Preston Wilson, Austin, TX (US); Kevin M. Lee, Austin, TX (US); Mark S. Wochner, Austin, TX (US); Hector L. Mendez Martinez, Houston, TX (US)

(73) Assignee: Board of Regents, The Univesity Systems, Austin, TX (US)

( * ) Notice: Subject to any disclaimer, the term of this patent is extended or adjusted under 35 U.S.C. 154(b) by 0 days.

(21) Appl. No.: 15/076,879

(22) Filed: Mar. 22, 2016

(65) Prior Publication Data

US 2016/0203812 A1 Jul. 14, 2016

Related U.S. Application Data

(63) Continuation of application No. 14/494,700, filed on Sep. 24, 2014, now Pat. No. 9,343,059.

(Continued)

(51) Int. Cl.
*G10K 11/172* (2006.01)

(52) U.S. Cl.
CPC ..... *G10K 11/172* (2013.01); *G10K 2200/11* (2013.01)

(58) Field of Classification Search
CPC ..... G10K 11/172

(Continued)

(56) References Cited

U.S. PATENT DOCUMENTS 2,528,049 A 10/1950 Gonda
3,022,632 A * 2/1962 Parks ..... E02B 3/062 405/26

(Continued)

FOREIGN PATENT DOCUMENTS

CN 102094922 11/2012
EP 2546829 A2 1/2013

(Continued)

OTHER PUBLICATIONS

U. Ingard, "On the Theory and Design of Acoustic Resonators", The Journal of the Acoustical Society of America, Nov. 1953, p. 1037-1062, vol. 25, No. 6.

(Continued)

*Primary Examiner* — Forrest M Phillips
(74) *Attorney, Agent, or Firm* — Intrinsic Law Corp.; Ibrahim M. Hallaj

(57) ABSTRACT

A system for reducing noise emissions in underwater environments is presented. The system can be extended to applications in any two-fluid environments where one fluid (gas) is contained in an enclosed resonator volume connected to the outside environment at an open end of the resonator body. The resonators act as gas-containing (e.g., air) Helmholtz resonators constructed into solid panels that are submerged in the fluid medium (e.g., sea water) in the vicinity of a noise generating source. The oscillations of the trapped air volume in the resonators causes reduction of certain noise energy and a general reduction in the transmitted noise in the environment of the system.

20 Claims, 11 Drawing Sheets

Related U.S. Application Data

(60) Provisional application No. 61/881,740, filed on Sep. 24, 2013.

(58) Field of Classification Search
USPC ..... 181/293
See application file for complete search history.

(56) References Cited

U.S. PATENT DOCUMENTS

| | | | | |
|---|---|---|---|---|
| 3,886,491 | A | 5/1975 | Jonkey et al. | |
| 4,241,806 | A | 12/1980 | Metzger | |
| 5,394,786 | A | 3/1995 | Gettle et al. | |
| 5,457,291 | A * | 10/1995 | Richardson | B28B 23/0068 181/293 |
| 5,658,656 | A | 8/1997 | Whitney et al. | |
| 5,959,938 | A | 9/1999 | Behrens | |
| 6,125,965 | A | 10/2000 | Wang | |
| 6,567,341 | B2 | 5/2003 | Dreyer et al. | |
| 6,571,906 | B2 | 6/2003 | Jones et al. | |
| 6,743,367 | B2 | 6/2004 | Dreyer | |
| 6,977,109 | B1 * | 12/2005 | Wood | G10K 11/16 181/292 |
| 7,126,875 | B2 | 10/2006 | Baskerville et al. | |
| 7,896,126 | B1 | 3/2011 | Haberman et al. | |
| 7,905,323 | B2 | 3/2011 | Larsen | |
| 8,276,889 | B2 | 10/2012 | Norris et al. | |
| 8,387,746 | B2 | 3/2013 | Parkin | |
| 8,500,369 | B2 | 8/2013 | Mohr | |
| 8,636,101 | B2 | 1/2014 | Elmer | |
| 8,689,935 | B2 | 4/2014 | Wilson et al. | |
| 9,343,059 | B2 * | 5/2016 | Wilson | G10K 11/172 |
| 2003/0006090 | A1 | 1/2003 | Reed | |
| 2004/0146396 | A1 * | 7/2004 | Liu | F04D 29/665 415/119 |
| 2005/0083783 | A1 | 4/2005 | Baskerville et al. | |
| 2005/0167193 | A1 * | 8/2005 | Van Reeth | E01F 8/0082 181/293 |
| 2007/0140518 | A1 | 6/2007 | Larsen | |
| 2009/0145688 | A1 | 6/2009 | Marcoux | |
| 2011/0031062 | A1 | 2/2011 | Elmer | |
| 2012/0097476 | A1 | 4/2012 | Jung et al. | |
| 2012/0241039 | A1 | 9/2012 | Jung et al. | |
| 2013/0001010 | A1 | 1/2013 | Wilson et al. | |
| 2013/0056270 | A1 | 3/2013 | Ward | |

FOREIGN PATENT DOCUMENTS

| | | | |
|---|---|---|---|
| EP | 2657410 | A2 | 10/2013 |
| WO | WO2009108071 | A9 | 9/2009 |
| WO | WO2013102459 | A2 | 7/2013 |

OTHER PUBLICATIONS

K. M. Lee et al., "Sound propagation in water containing large tethered spherical encapsulated gas bubbles with resonance frequencies in the 50 Hz to 100 Hz range", J. Acoust. Soc. Am., Nov. 2011, p. 3325-3332, vol. 130, No. 5, Acoustical Society of America.

K. Lee et al., "Attenuation of low-frequency underwater sound using bubble resonance phenomena and acoustic impedance mismatching", 160th Meeting Acoustical Society of America, Nov. 2010, vol. 11, The Acoustical Society of America though the American Institute of Physics.

US International Searching Authority, "International Search Report for Application No. PCT/US14/70602", May 22, 2015, WIPO.

Lee et al., "Mitigation of low-frequency underwater sound using large encapsulated bubbles and freely-rising bubble clouds", p. 1-15.

* cited by examiner

UNDERWATER NOISE ABATEMENT PANEL AND RESONATOR STRUCTURE

RELATED APPLICATIONS

This application is a continuation of U.S. application Ser. No. 14/494,700, entitled "Underwater Noise Abatement Panel and Resonator Structure," filed on Sep. 24, 2014, which claims the benefit of and priority to U.S. Provisional Application No. 61/881,740, entitled "Reducing Underwater Noise Using Gas Trapped in Pockets on Submerged Objects," filed on Sep. 24, 2013, both of which are hereby incorporated by reference.

TECHNICAL FIELD

The present disclosure relates to abatement of noise generated by sea-faring vessels and other natural or man-made sources of sound in water using a submerged panel having cavities containing a resonating gas volume therein.

BACKGROUND

Ships that operate in environmentally sensitive or highly regulated regions can be limited in the manner or time in which they can operate due to the noise generated by the ship. This occurs in the oil and gas field, where noise from mobile drilling ships limits drilling time due to the effect that the noise can have on migrating bowhead whales in Arctic regions. When bowhead whales are sighted, operations may be halted until they have safely passed, and this process can take many hours.

In addition, there is growing concern over the effect that shipping noise has on marine mammals. Some studies suggest that shipping noise can have a significant impact on the whale's stress hormone levels, which might affect their reproduction rates, etc.

Known attempts to reduce noise emissions from surface ships include the use of a so-called Prairie Masker, which uses bands of hoses that produce small freely-rising bubbles to mitigate ship's noise. However, small freely-rising bubbles are usually too small to effectively attenuate low-frequency noise. In addition, Prairie Masker systems require continuous pumping of air through the system, a process itself that produces unwanted noise, and also consuming energy and requiring a complex gas circulation system that is costly and cumbersome to the other operations of the ship. Finally, such systems cannot operate efficiently at large depths due to the challenges of delivering (e.g., pumping) sufficient amounts of air to significant depths.

One principle that is useful in approximating or understanding the acoustic effects of gas pockets in liquid (e.g., air pockets or bubbles or enclosures in water) is the behavior of spherical gas bubbles in liquid. The physics of gas bubbles is relatively well known and has been studied theoretically, experimentally and numerically.

FIG. 1 illustrates a gas (e.g., air) bubble in liquid (e.g., water). One model 10 represented by FIG. 1 for studying the response of gas bubbles is to model the bubble of radius "a" as a mass on a spring system. The effective mass is "m" and the spring is modeled as having an effective spring constant "k". The bubble's radius will vary with pressures felt at its walls, causing the bubble to change size as the gas therein is compressed and expands. In some scenarios the bubble can oscillate or resonate at some resonance frequency, analogous to how the mass on spring system can resonate at a natural frequency determined by said mass, spring constant and bubble size according to a generalized Hook's law.

The movement of gas volumes enclosed by liquid can absorb ambient underwater sound or sound in an environment generally. These phenomena have been studied by others and by the present inventors and exploited for various purposes. For example, U.S. Pat. No. 8,636,101 and similar works are directed to scattering and damping of acoustic energy by a system of encapsulated air bladders tied to an underwater rigging. U.S. Pat. No. 7,905,323 and similar works are directed to studying the mechanism for absorption of acoustic energy in a gas filled cavity, generally to affect the acoustics of a room. U.S. Pat. No. 7,126,875 and U.S. Pat. No. 6,571,906 and similar works are directed to generating sound dampening bubble clouds from a bubble producing apparatus submerged under water. While U.S. Pat. No. 6,567,341 is directed to a boom with a gas injection system forming gas bubbles placed around a waterborne noise source to reduce the propagation of noise from the source.

Each of the above type of systems are intended to either cause an acoustic impedance mismatch or to cause resonance in a gas bubble or bubble cloud or gas-filled balloon so as to absorb and/or scatter acoustic noise energy present in the vicinity of the bubbles or balloons. The mechanics of these systems generally rely on the bubble-to-water interface to offer a resonator as described above to as to attenuate sound energy. Each of the above systems is of a given effectiveness and practicality, which may be suitable for some applications and may remain options available to system designers in the field.

SUMMARY

Gas trapped in the pockets under or around an object in the water will act as Helmholtz resonators and thus work to abate noise in much the same way as a resonant bubble. To give an example of how this would work in on a ship, a panel with hemispherical or cylindrical cavities could be attached to its hull, and while submerged the pockets could be filled with gas via an external mechanism or an internal manifold system, or the air could be trapped from when it was out of the water. The properties of these pockets would be chosen so that the gas trapped within each pocket resonates at or near the frequencies that we wish to attenuate, thus maximizing their efficacy.

The system is customizable and can attenuate noise to the amount desired. The system can also be produced to specifically target frequencies that are particularly loud.

This system may allow the operator to work for longer periods of time and in areas previously unavailable due to noise regulations. This system is also much more effective at reducing noise than current technology because each gas cavity is built so that the gas trapped inside will maximally reduce the targeted underwater noise. In addition it does not require power or expensive support equipment.

An embodiment is directed to a system for reducing underwater noise, comprising a solid panel having a thickness at any given location on the panel and having two generally opposing faces of said panel; a plurality of resonator cavities defined within said panel; each resonator cavity having a closed end within said panel and an open end through which an interior of said resonator cavity is in fluid communication with surrounding of said panel; each resonator cavity further defining a volume described by a geometry of said resonator cavity within said panel; and each resonator cavity configured and arranged within said panel so as to have at least a portion of said volume of the resonator cavity disposed higher than said open end so as to be capable of trapping an amount of gas within the resonator cavity.

Another embodiment is directed to a method for reducing underwater noise, comprising substantially filling a chamber of a Helmholtz resonator with a first fluid; and submerging said resonator in a second fluid being different from said first fluid so as to create a two-fluid interface between said first and second fluids proximal to an opening of said resonator. The resonator creating the two-fluid interface can be duplicated to make a multi-resonator arrangement and disposing one or more of said submerged resonators proximal to an object of interest such as a noise generating object or a noise-sensitive object at which we wish to reduce the noise.

BRIEF DESCRIPTION OF THE DRAWINGS

For a fuller understanding of the nature and advantages of the present invention, reference is made to the accompanying drawings illustrating exemplary aspects and embodiments of the invention, in which.

DETAILED DESCRIPTION

Gas trapped in the pockets under or around an object in the water will act as Helmholtz resonators and thus work to abate noise in much the same way as a resonant bubble.

Figure 2:
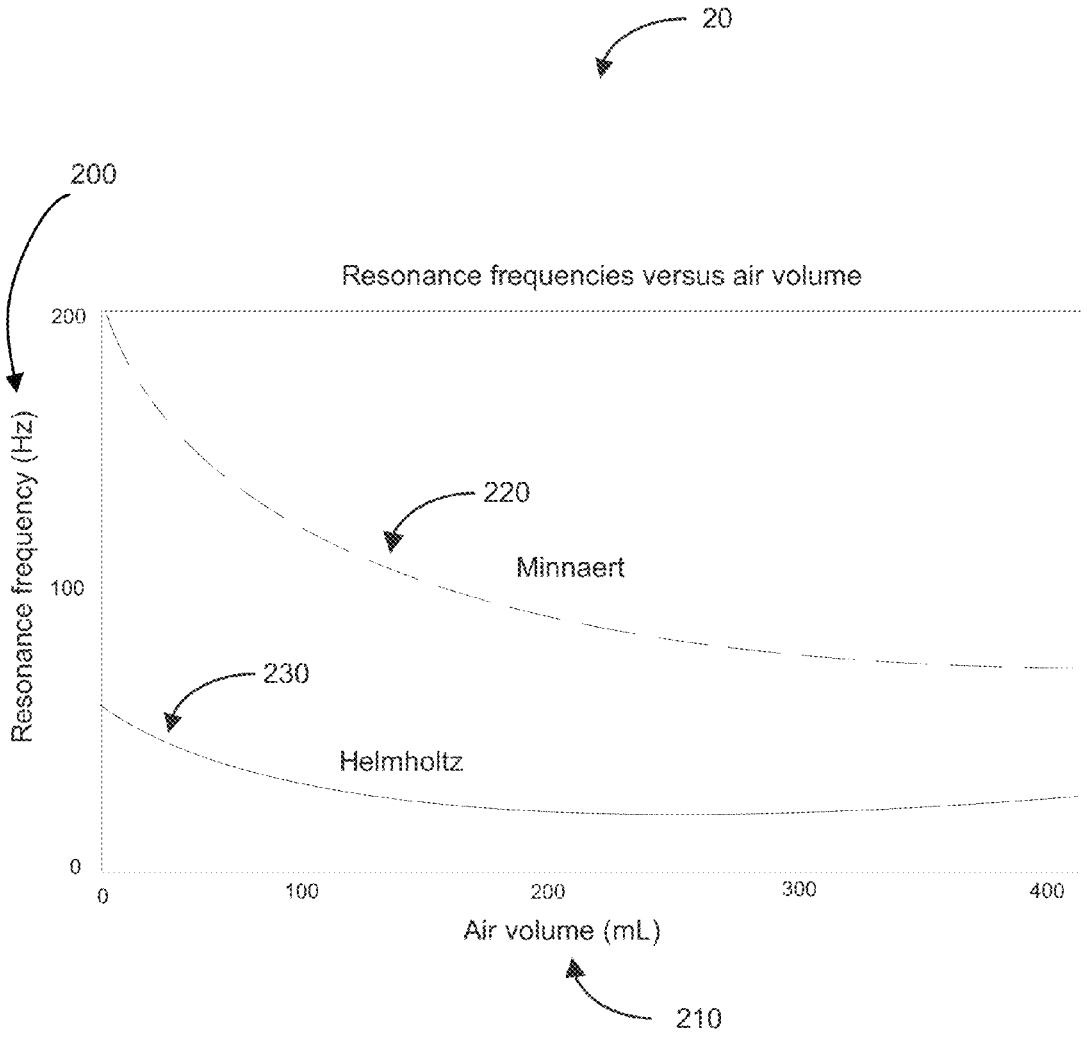
FIG. 2 illustrates an exemplary plot of the Minnaert and the Helmholtz responses of resonators.

An air cavity can be accomplished in a number of ways for the purpose of causing resonance in the cavity to absorb acoustic energy. FIG. 2 illustrates modeling results 20 by the present inventors whereby the resonance frequency 200 of an air cavity in water is plotted as a function of the volume of air 210 in the cavity. An idealized resonance frequency 220 of an air filled Helmholtz resonator under water is given by:

$$\omega_0^2 = \frac{\gamma P_0}{\rho_\ell} \frac{S}{VL'}$$

where $\gamma$ is the ratio of specific heats of the gas inside the resonator, $\rho_l$ is the density of the liquid outside the resonator, $P_0$ is hydrostatic pressure at the location of the resonator, S is the cross sectional area of the opening of the resonator, V is the volume of air inside the resonator, and L' is the effective neck length of the resonator. The frequency is given here in units of radians per second. The idealized resonance frequency 230 (or Minnaert frequency) of an air bubble in water is given by:

$$\omega_0^2 = \frac{3\gamma P_0}{\rho_\ell a^2}$$

where a is the radius of the spherical gas bubble. The frequency is given here in units of radians per second.

Figure 3:
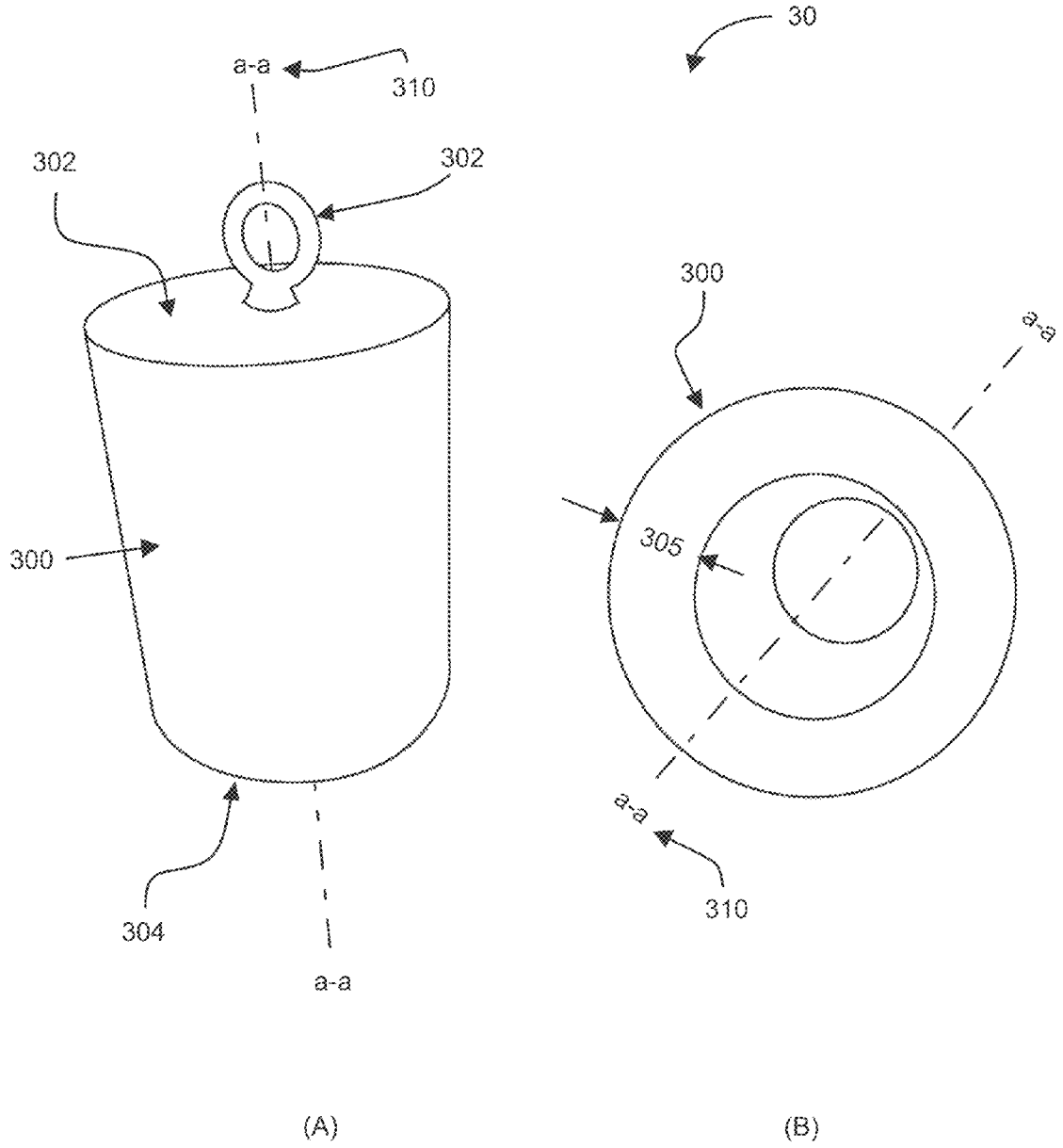
FIG. 3 illustrates exemplary perspectives of a bell resonator chamber.

FIG. 3 illustrates an exemplary experimental stainless steel cylinder resonator 30 with an open end into which air can be trapped and the device submerged under water. FIG. 3(A) illustrates a perspective view of the open-ended steel or brass resonator 30. The resonator has a substantially cylindrical body or shell 300 and a closed end 302 and an open end 304 generally forming a bell body. The body 300 has a thickness as shown in end-view FIG. 3(B) having a wall thickness 305. A hanger or handle, hook or eye 310 can be used to support the weight of the resonator such as by suspending the resonator 30 underwater. The overall resonator 30 is constructed of a material (e.g., metal such as brass, zinc, or steel) that is heavier than the liquid it is to be used in (e.g., sea water). Even when a volume of gas (e.g., air) is trapped inside the inner volume of the resonator body 300, providing some buoyancy, the overall object will still sink or remain submerged due to the downward pull of gravity on the heavy structure of metal body 300, which also will act to stabilize the object and keep it upright so that an axis of the resonator (a-a) is generally aligned with the gravitational force vector acting on the object. Thus, air trapped in the body 300 of resonator 30 would not escape out of downward-facing open end 304 during use. Instead, an air-water interface will be defined at or near the open end 304 of bell housing 300. This air-water interface will act as an area experiencing any acoustical forces in the vicinity of the resonator 30 and can act as a Helmholtz resonator to absorb, dampen, mitigate or generally reduce the effects of some or many acoustic energy frequency components in the liquid surrounding submerged resonator 30.

We now turn to other instances of Helmholtz resonators containing a gas (for example air, but not limited to air) submerged in a surrounding liquid (for example sea water, but not limited to that). In addition, we will examine sound attenuating systems comprising a plurality of such resonators in a shaped panel adapted for a given application.

The following figures illustrate exemplary panels that have a plurality of spaced indentations, pockets, or other volumetric cavities taken therefrom. The volumetric cavities can be of almost any size or shape suiting a given application. The panels may serve other functions. For example, the panels may be structural in nature and part of a design of a vessel, platform or other industrial, military or recreational device causing or proximal to acoustic noise sources of interest.

Figure 4:
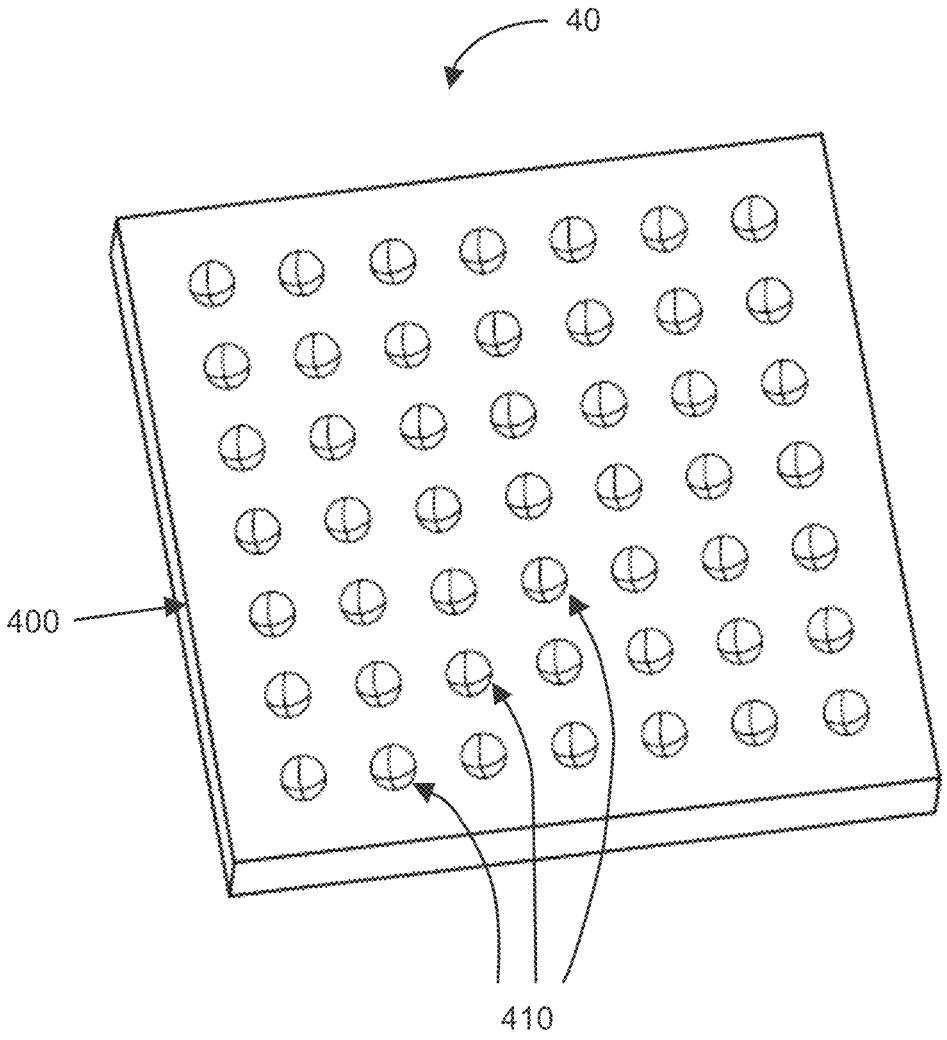
FIGS. 4-6 illustrate various embodiments of a noise abatement panel with a plurality of resonator cavities formed therein.

FIG. 4 illustrates an exemplary embodiment of a sound reduction panel 40. The panel comprises a substantially solid, rigid, or nearly rigid panel wall 400 of a finite thickness. The panel wall includes or is shaped or formed to include a plurality of resonator cavities 410 therein. Depending on the application, the panel 40 may be of simple construction and have no moving parts and be very durable and easy to use. The user would allow a gas (e.g., air) to fill the resonator cavities 410 either by placing the panel 40 in the open air or by pumping or injecting air into the cavities 410. Then, the device can be placed into the liquid surroundings (e.g., natural or artificial body of water, ocean, sea, lake, harbor, river, reservoir, pool, etc.) by lowering it or the vessel that it is part of or attached to into the liquid surroundings. The air will remain trapped in the cavities, which act as resonators (e.g., Helmholtz resonators) and dissipate or reduce the underwater noise levels in the vicinity of the panel 40.

Figure 5:
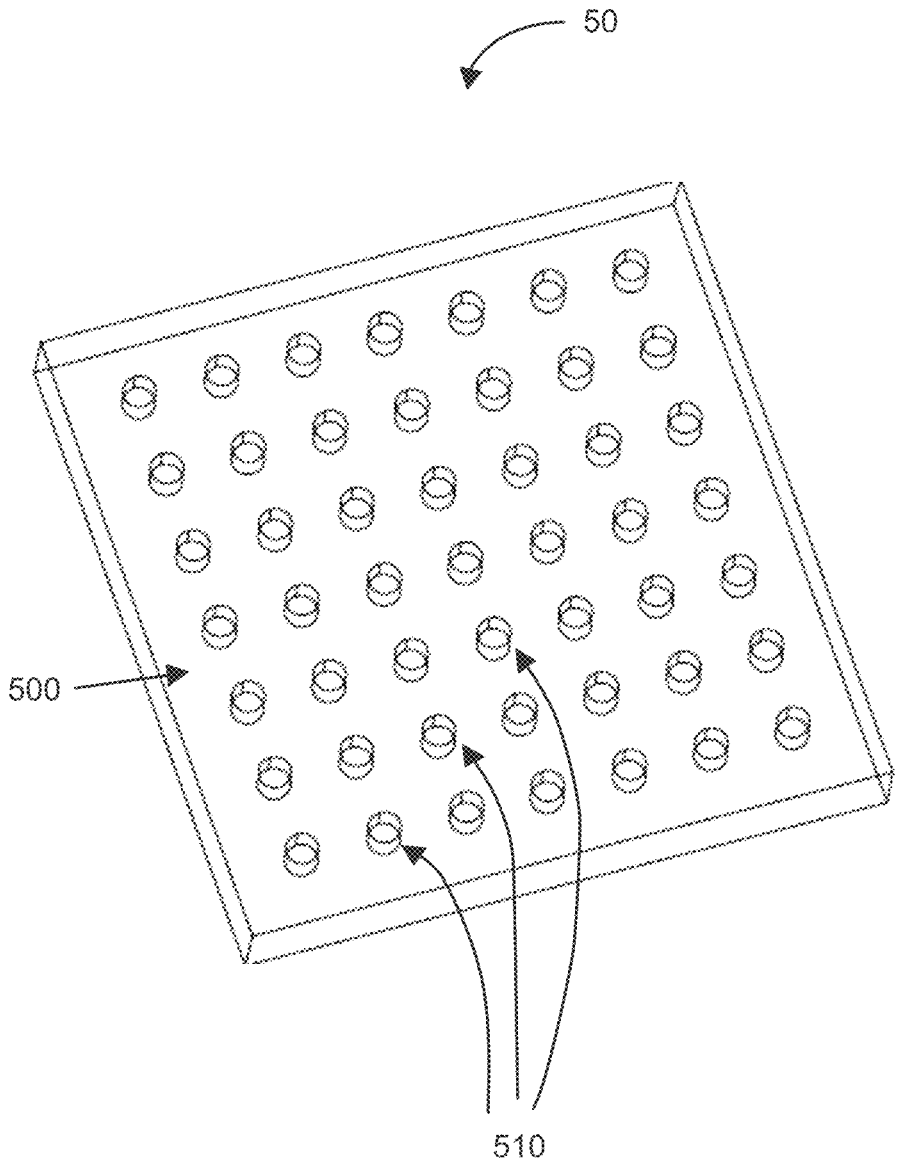

FIG. 5 illustrates a similar panel 50 comprising a solid panel sheet 500 with a plurality of cylindrical cavities 510 therein which operate similarly to the above described FIG. 4.

Figure 6:
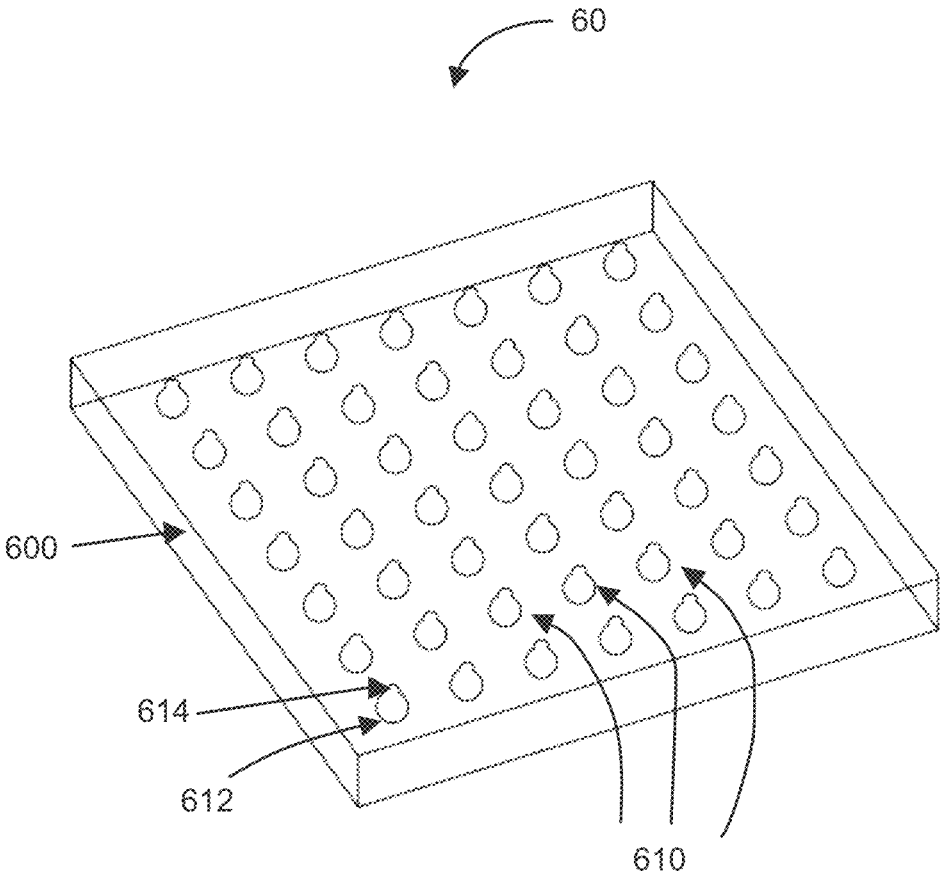

FIG. 6 illustrates another panel with a plurality of inverted bottom round flask shaped cavities 610. The flask shaped cavities 610 may each have a main cavity defined by a body 612 as well as a narrowed 'neck' 614 in fluid communication with the main part of the cavity's body 612.

Note that in the present designs and embodiments, a panel (40, 50, 60) may be of almost any shape suited for a given application. Also, the panels do not necessarily need to be flat or square or rectangular in shape, but rather, they may have some overall contour or three-dimensional curvature to their face. In addition, the resonator cavities (410, 510, 610) do not necessarily have to be all of a same shape or size in a given panel. The sizes, shapes and locations of the individual resonator cavities on the panels may be chosen to suit a given application. The cavities are not limited in their placement to a grid or a regular spacing. For example, two different shapes or sizes of resonators may be included in a same panel design to address two particular anticipated noise components. For experimental purposes, testing and optimization of a design, a spherical acceleration source can be placed in a test tank with the inverted panels where the cavities each contain a trapped volume of air allowed to respond to acoustic stimuli.

Figure 7:
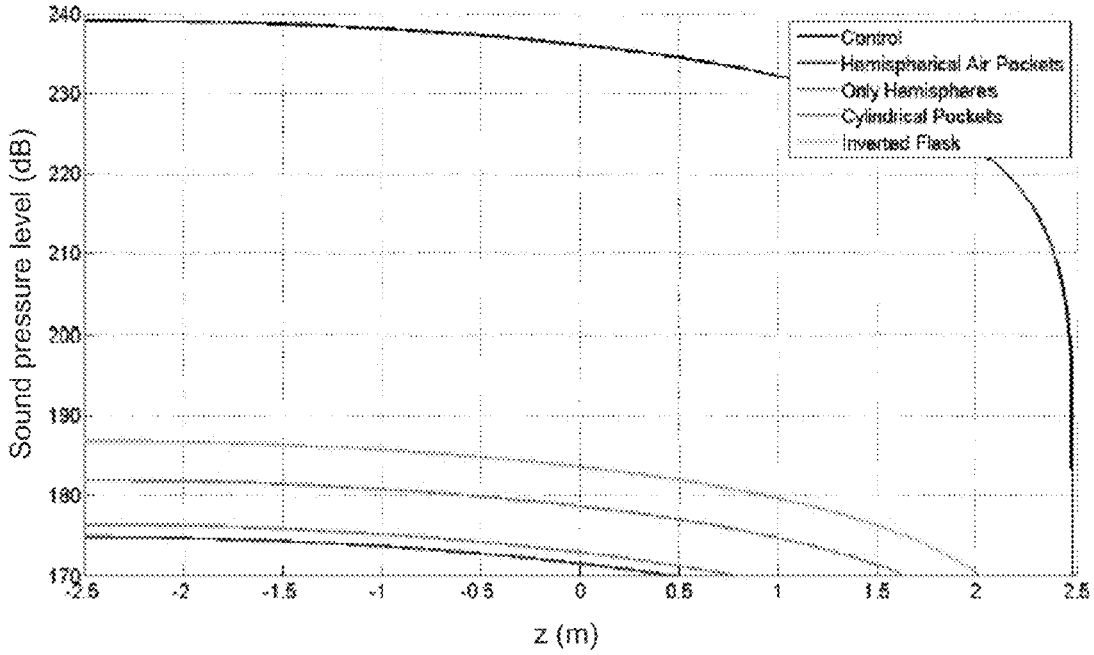
FIG. 7 illustrates modeled performance curves for reduction of sound pressure as a function of vertical position of a resonator cavity in a noise reducing panel system.

FIG. 7 illustrates an exemplary response for the types of cavities described above in respective panels whereby the cavities are air filled and then the inverted panels with the trapped air cavities are submerged in the water test tank. The figure shows the sound pressure level (indicating sound damping) as a function of "z" describing the depth of the cavity with respect to the centerline depth of the test tank. Because the hydrostatic pressure increases with increasing depth, the physics of the resonators will vary by their depth (z) among other design factors.

Figure 8:
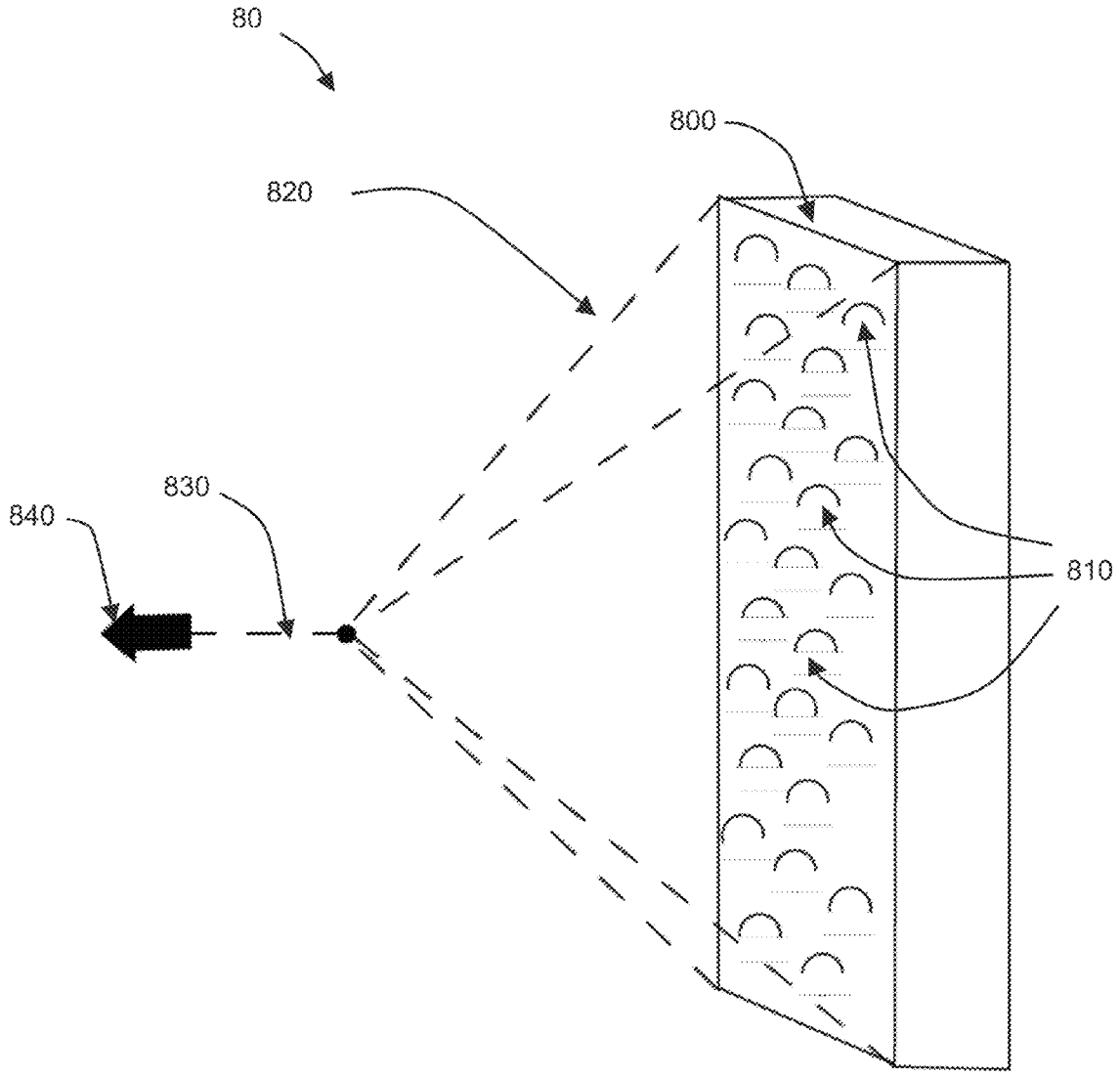
FIG. 8 illustrates a towed noise reducing panel.

FIG. 8 illustrates a towed acoustic noise abatement system 80 comprising one or more panels 800 similar to those described herein and comprising that act as acoustic resonators 810 in the panels 800 that trap air in them so as to retain a resonating volume of air in each resonator or cavity 810 and reduce noise emissions in the environ of the system 80 and beyond. The individual resonator cavities 810 can be constructed according to any design suited for an application, including as described in the present exemplary embodiments. Support lines 820 may allow for towing of the panels 800 in a towed or tethered configuration. A tie-off connection point 830 may be coupled to a tow line which applies a force along a direction 840. Therefore, the system 80 can be used in a moving configuration under water as well as in a stationary configuration, or combination of both. In an embodiment, the panels 800 of system 80 can be connected so as to be substantially vertical during use, and the air filled resonators 810 can have an upturned interior cavity so as to trap air therein, as will be described further below. It should be noted that the types of panels described earlier can be configured and arranged so that the air trapped in their resonator cavities remains stable in the cavities during use due to the force of gravity (or buoyancy) because the air is less dense than water.

Figure 9:
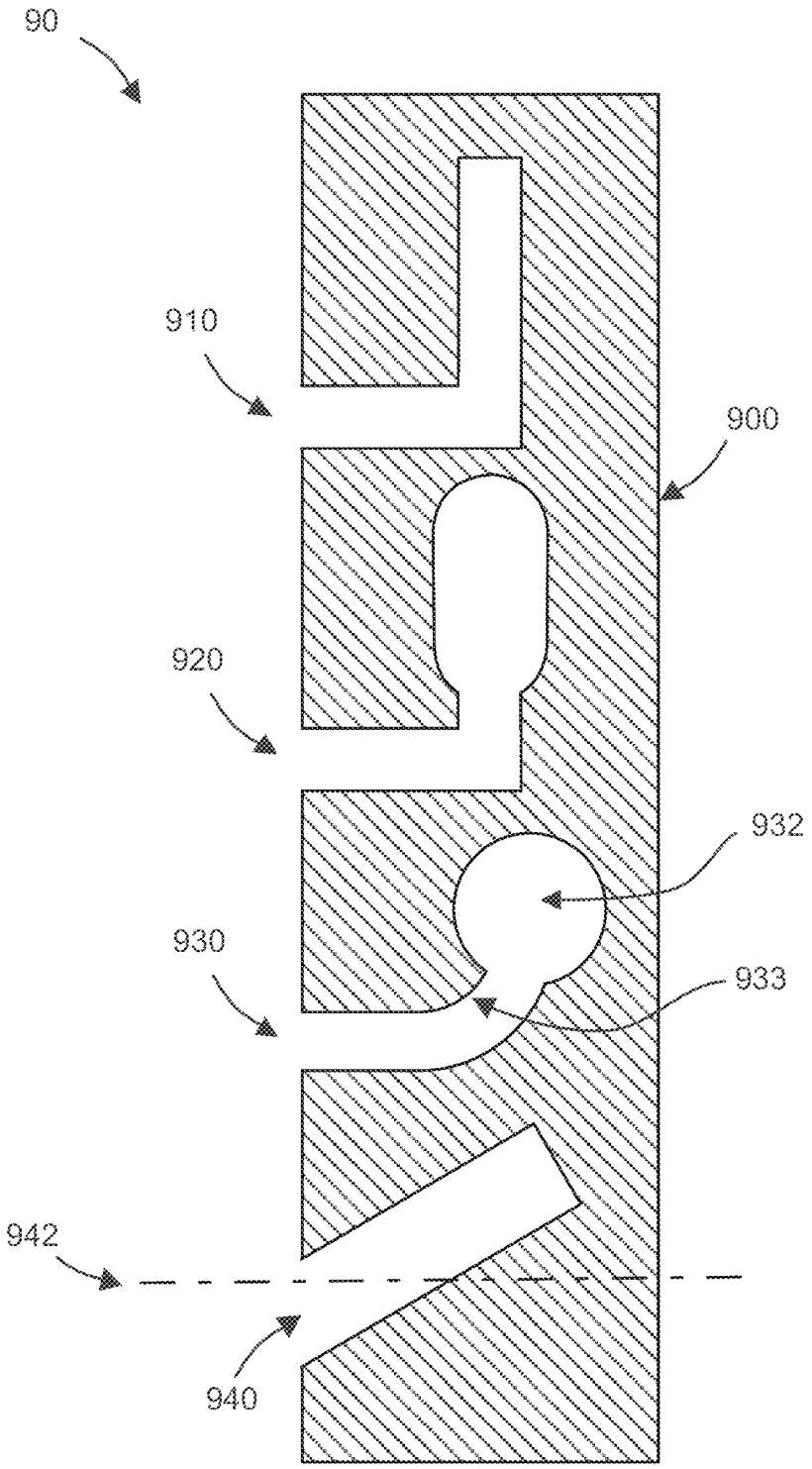
FIG. 9 illustrates a cross section of a noise reducing panel having variously shaped resonator cavities.

FIG. 9 illustrates in cross section exemplary noise abatement resonator structures in a panel 90 of such resonators. The drawing is not necessarily drawn to any scale, but is presented for the purpose of clarifying the configuration and operation of the system.

As mentioned in other embodiments, the system 90 comprises a solid panel structure 900, which can be a sheet material of some thickness and density of construction. In an aspect, the density of the sheet material of panel structure 900 is greater than that of the fluid into which it is to be submerged (for example, water). In another aspect, the panel 900 is formable by pouring or injecting in one or more parts using a mold. In another aspect, the resonator cavities 910, 920, 930, 940 may be formed by machining, chemical etching, and so on.

As to the resonator cavities 910, 920, 930, 940, these are adapted so that they trap a volume of gas (for example air) therein during use when the panel 900 is submerged in a liquid (for example sea water). The cavities 910, 920, 930, 940 can be filled a priori when the panel 900 is above the surface of the water, or the cavities may be filled using a gas injection system such as an air pump that forces air into the cavities 910, 920, 930, 940 once the panel 900 is under water. The volume of air in the cavities may be refreshed from time to time (e.g., using forced injection or percolation) in case some of the trapped air in the cavities spills out or is dissolved in the surrounding liquid.

Some resonator cavities may have access from the face of the panel but an elevated volume within the panel so as to trap a volume of air therein when the panel 900 is oriented vertically (or having a vertical elevation to its position) as shown in FIG. 9. The cavities 910, 920, 930, 940 are illustrated as having a variety of cross sectional shapes. They can be L-shaped (910) or J-shaped or hook-like so that they have a neck allowing acoustic communication between the cavity and the body of water surrounding the panel. Cylindrical or bulbous flask-shaped cavities (920, 930) are shown by way of example for illustration only, but others are possible. In addition, there can be a main gas-filled volume (932) in fluid communication, through a conduit 933, with the surrounding liquid in which the panel 900 is submerged. In another example, a resonator cavity can include a bore or slot 940 cut at an upwardly sloping angle with respect to the face of the panel, or with respect to the gravitationally-defined horizontal plane 942.

Figure 1:
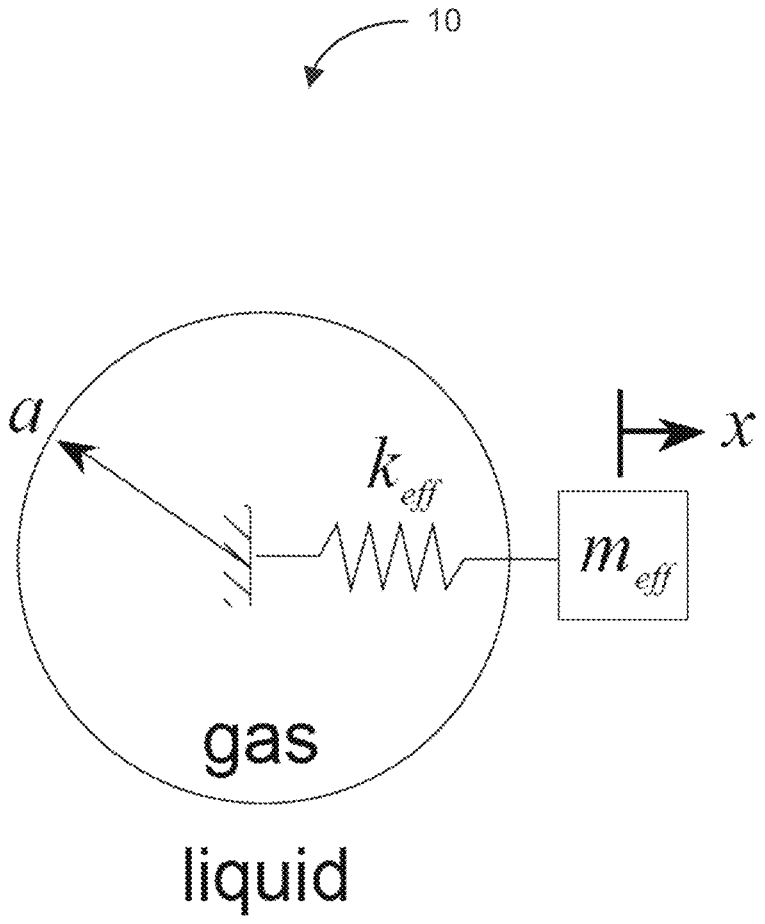
Fig. 1 (PRIOR ART)
FIG. 1 shows a basic model of a resonating gas bubble in liquid according to the prior art.

The relative height of the interior volume of the cavities and their volumes are configurable to suit the purpose at hand. The cavities can be considered as defined by the volume of gas trapped therein, which can vary and sometimes some liquid can push itself into at least part of the cavity. Given that static water pressure in the ocean or bay or river the panels are in varies with depth below the surface, the cavities' size and/or shape can vary according to their location with respect to the water line on the face of the panel. Meaning, the cavities may be designed to accommodate the change in water pressure felt at the neck of the cavities due to the depth to which they are submerged, as (in the analogy of FIG. 1) their spring constants can change according to the density and depth of water around them.

Figure 10:
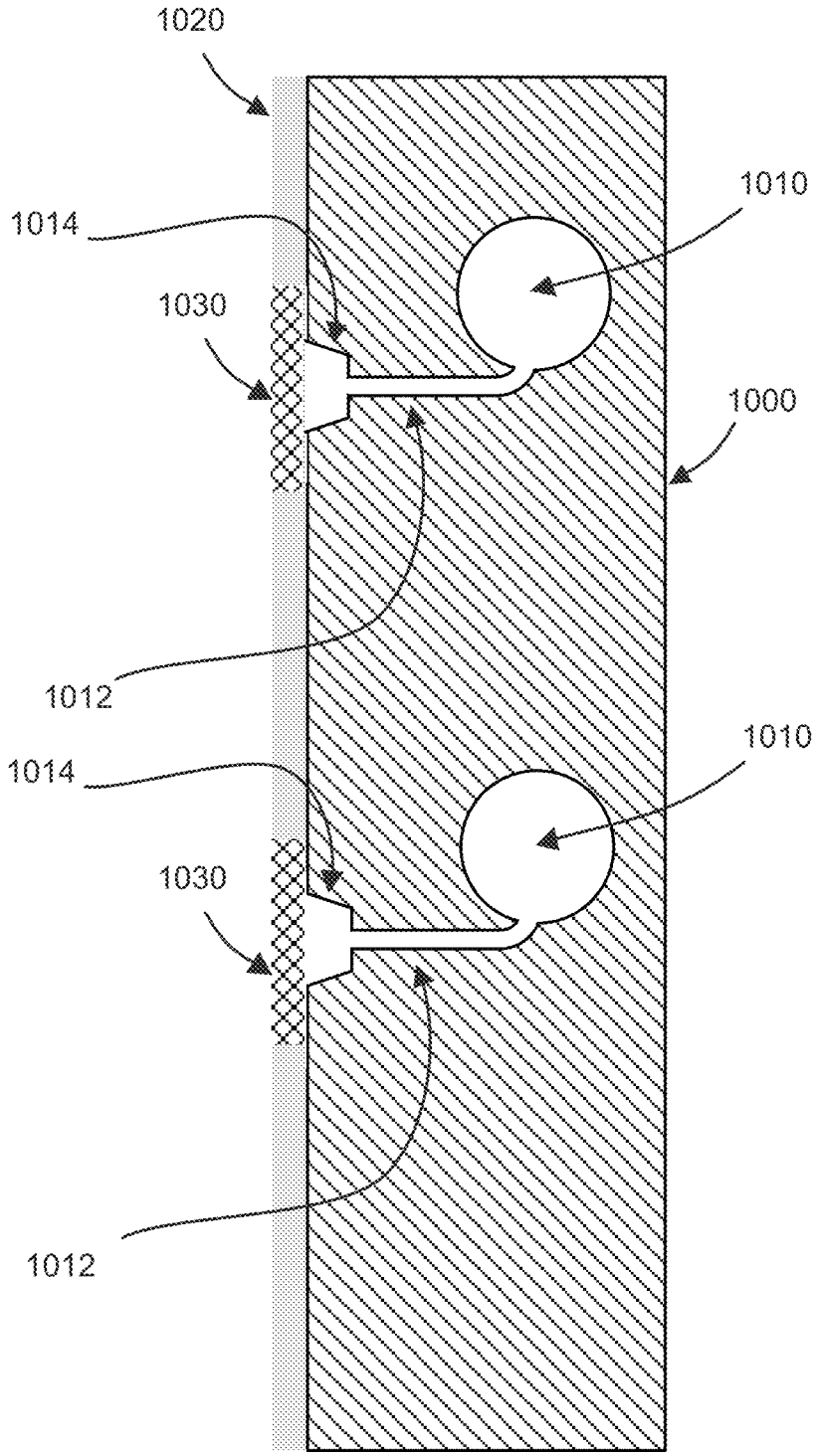
FIG. 10 illustrates a cross section of a noise reducing panel having resonator cavities with reduced size necks and showing a cover layer with partially permeable grating covering the openings of the resonators at their open ends.

In some embodiments, a mesh or other solid screen such as a metal screen (e.g., copper screen) can be placed over the face of the panels. This can act to stabilize the air in the cavities. This can also act as a heat sink to dissipate thermal energy absorbed by the resonating volume of the cavity and improve its performance. FIG. 10 illustrates a noise abatement panel 1000 in cross section. The panel has one face (the one with the exposed ends of cavities 1010) covered with a metal layer 1020 that includes meshed or grated or perforated or fluid-permeable openings 1030 covering the open ends 1014 of the resonator cavities. In an embodiment, some resonator cavities 1010 can be designed to have a relatively constricted channel 1012, which can connect an open end 1014 of the resonator cavities with their internal gas filled volumes. So FIG. 10 illustrates a cross section of a noise reducing panel having resonator cavities with reduced size necks and showing a cover layer with partially permeable grating covering the openings of the resonators at their open ends. In yet another aspect, the open ends 1014 of the resonator cavities may be designed to have a flanged termination where they meet the face of panel 1000.

This invention is not limited to use in surface or subsurface ships and vessels, but may be used by oil and gas companies drilling in the ocean (e.g., on rigs and barges), offshore power generation platforms (e.g., turbines and wind farms), as well as in bridge and pier construction or any other manmade noise-producing structures and other activities such as dredging.

As far as applications of the current system, one can prepare panels similar to those described above for attachment to submerged structures or vessels. The panels can include a plurality of gas (e.g., air) cavities where the buoyancy of the air in the water environment causes the air to remain within the cavities. The cavities can be filled by the act of inverted submersion of the panels or structure. Alternatively, the cavities can be actively filled using an air source disposed beneath the cavities so that the air from the source can rise up into and then remain in the cavities. The cavities may need to be replenished from time to time.

In some embodiments, gas other than air may be used to fill the cavities. The temperature of the gas in the cavities may also affect their performance and resonance frequencies, and so this can also be modified in some embodiments.

Various hull designs can accommodate separate panels like those described herein, or the hull can be manufactured with the cavities ready-made in its sides. It can be appreciated that the present designs are applicable to environments generally such as oil drilling rigs, underwater explosions, shock testing, off shore wind farms, or noise from other natural or man-made underwater sources.

Many other designs can be developed for noise abatement and damping purposes. In other embodiments, the resonating cavity may be filled with a liquid fluid instead of a gas fluid. For example, if the system is to be operated at extreme depths in the ocean, a liquid other than water having a compressibility different than that of sea water could also be used, as would be appreciated by those skilled in the art.

Figure 11:
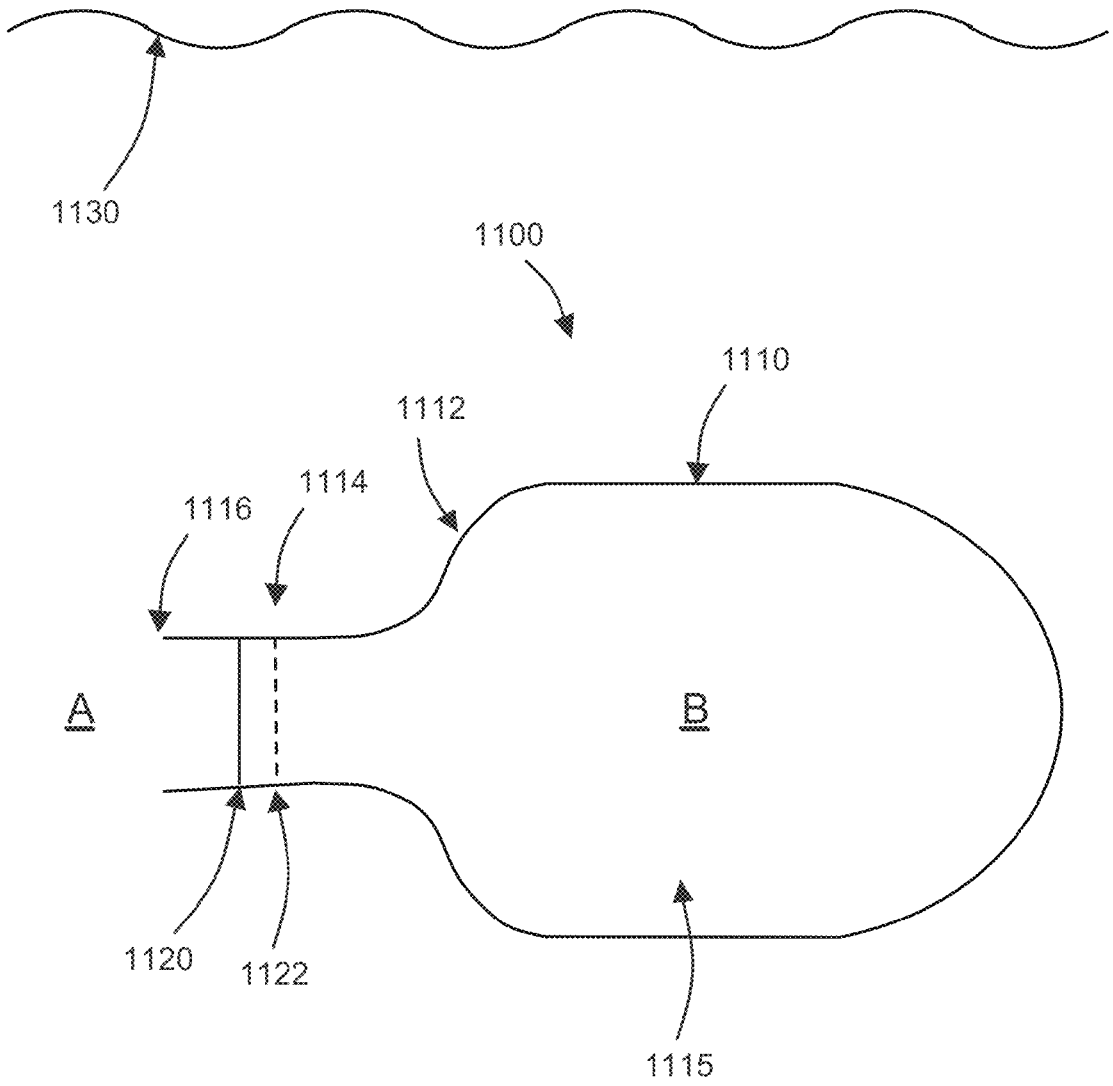
FIG. 11 illustrates a Helmholtz resonator (which generally holds a first fluid and is immersed in a second fluid) for use in the present context.

FIG. 11 illustrates an acoustic resonator 1100 applied to a two-fluid environment where a first fluid is represented in the drawing by A and the second fluid is represented by B. For the purpose of illustration only, the two-fluid environment can be a liquid-gas environment. In a more particular illustrative example, the liquid may be water and the gas may be air. In a yet more particular example, the liquid may be sea water (or other natural body of water) and the gas may be atmospheric air.

An embodiment of resonator 1100 has an outer body or shell 1110 with a main volume 1115 of fluid B contained therein. The body 1110 may be substantially spherical, cylindrical, or bulbous. A tapered section 1112 near one end brings down the walls of the body 1110 to a narrowed neck section 1114. The neck section 1114 has a mouth 1116 providing an opening that puts the fluids A and B in fluid communication with one another in or near the neck section 1114 at a two-fluid interface 1120. In operation, pressure oscillations (acoustic noise) present outside the resonator 1100 in fluid A will be felt in or near the neck section 1114 of the resonator. Expansion, contraction, pressure variations and other hydrodynamic variables can cause the fluid interface to move about within the area of the neck 1114 as illustrated by dashed line 1122.

The resonator of FIG. 11 is therefore configured to allow reduction of sound energy in the vicinity of the resonator 1100 through Helmholtz resonator oscillations, which depend on a number of factors such as the composition of fluids A, B and the volume of the second fluid B with respect to the volume of the fluids B and/or A in the neck section 1114, the cross-sectional area of opening 1116, and other factors.

A plurality of resonators 1100 may be disposed at or near an underwater noise source such as a ship or oil drilling rig or other natural or man-made noise source. Also, a plurality of resonators 1100 may be disposed at or near a location (e.g., underwater) that is to be shielded from external noise sources. That is, the resonators 1100 may be anywhere suitable so as to mitigate an effect of underwater noise, including in a noise reducing apparatus near the noise source and/or near an area to be shielded from such noise.

Those skilled in the art will appreciate upon review of the present disclosure that the ideas presented herein can be generalized, or particularized to a given application at hand. As such, this disclosure is not intended to be limited to the exemplary embodiments described, which are given for the purpose of illustration. Many other similar and equivalent embodiments and extensions of these ideas are also comprehended hereby.

What is claimed is:

1. A system for reducing underwater noise, comprising:

a solid panel having a thickness at any given location on the panel and having two generally opposing faces of said panel;

a plurality of resonator cavities defined within said panel;

each resonator cavity having a closed end within said panel and an open end through which an interior of said resonator cavity is in fluid communication with surrounding of said panel;

each resonator cavity further defining a volume described by a geometry of said resonator cavity within said panel; and each resonator cavity configured and arranged within said panel so as to have at least a portion of said volume of the resonator cavity disposed higher than said open end so as to be capable of trapping an amount of gas within the resonator cavity when said panel is submerged in a liquid, wherein said volume or said geometry of each resonator cavity varies according to a respective design depth of deployment of said resonator cavity in said liquid.

2. The system of claim 1, each resonator cavity further comprising an enlarged section proximal to a first face of said panel and a second section comprising a narrower neck proximal to a second face of said panel and connecting said enlarged section with environs of said panel through said neck section.

3. The system of claim 1, said resonator cavities comprising molded voids within a solid structure of said panel.

4. The system of claim 1, further comprising a cover layer on a face of said panel proximal to said closed ends of said resonator cavities, said cover layer having partially permeable structure at least where said cover layer covers said open ends of said resonator cavities.

5. The system of claim 4, said partially permeable structure comprising a perforated grating allowing fluid to pass therethrough.

6. The system of claim 1, said panel comprising a solid material more dense than water.

7. The system of claim 1, said open ends of said resonator cavities providing a two-fluid interface between a gas trapped within the volume of said resonator cavities and said liquid surrounding said panel.

8. The system of claim 1, further comprising mechanical attachment points on said panel so as to secure or pull said panel.

9. The system of claim 1, said resonator cavities comprising an upwardly cut bore into said panel.

10. The system of claim 1, further comprising a gas injection system in fluid communication with each resonator cavity, said gas injection system configured to inject a gas into each resonator cavity after said panel is submerged in said liquid.

11. The system of claim 1, wherein said volume or said geometry is selected to modify a resonance frequency of said resonator cavity according to a pressure of said liquid at said respective design depth of deployment.

12. A method for reducing underwater noise, comprising:

substantially filling a chamber of a Helmholtz resonator with a first fluid; and submerging said resonator in a second fluid being different from said first fluid so as to create a two-fluid interface between said first and second fluids proximal to an opening of said resonator, wherein (a) said second fluid is a liquid and (b) a volume or a geometry of said chamber is selected according to a design depth of deployment of said resonator in said liquid.

13. The method of claim 12, further comprising arranging a multi-resonator assembly of a plurality of said Helmholtz resonators.

14. The method of claim 12, substantially filling said resonator with a first fluid comprising filling said resonator with a gas fluid.

15. The method of claim 14, substantially filling said resonator with a first fluid comprising filling said resonator with air.

16. The method of claim 12, submerging said resonator in the second fluid comprising submerging said resonator in a body of water.

17. The method of claim 12, further comprising arranging said resonator within said second fluid proximal to an object of interest that is also disposed within said second fluid.

18. The method of claim 12, said two-fluid interface comprising a direct fluid-to-fluid interface between said first and second fluids.

19. The method of claim 12, further comprising injecting a gas into said chamber after said submerging said resonator in said second fluid.

20. The method of claim 12, wherein said volume or said geometry is selected to modify a resonance frequency of said resonator according to a pressure of said liquid at said respective design depth of deployment.

* * * * *